US010578085B1

(12) United States Patent
Stang

(10) Patent No.: US 10,578,085 B1
(45) Date of Patent: Mar. 3, 2020

(54) SEALED MODULAR FLUID DISTRIBUTION SYSTEM

(71) Applicant: Mark Lee Stang, Arvada, CO (US)

(72) Inventor: Mark Lee Stang, Arvada, CO (US)

( * ) Notice: Subject to any disclaimer, the term of this patent is extended or adjusted under 35 U.S.C. 154(b) by 176 days.

(21) Appl. No.: 15/960,255

(22) Filed: Apr. 23, 2018

Related U.S. Application Data

(60) Provisional application No. 62/492,481, filed on May 1, 2017.

(51) Int. Cl.

| | |
|---|---|
| ***F04B 43/067*** | (2006.01) |
| ***F04B 43/107*** | (2006.01) |
| ***F04B 43/02*** | (2006.01) |
| ***F04B 9/04*** | (2006.01) |
| ***F17C 7/02*** | (2006.01) |
| ***F04B 7/00*** | (2006.01) |
| ***F04B 43/073*** | (2006.01) |
| ***F04B 13/00*** | (2006.01) |
| ***F04B 23/06*** | (2006.01) |

(52) U.S. Cl.
CPC ..... *F04B 7/0003* (2013.01); *F04B 13/00* (2013.01); *F04B 23/06* (2013.01); *F04B 43/0733* (2013.01); *F17C 2201/0195* (2013.01); *F17C 2265/027* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,146,789 | A * | 9/1964 | Curth | F17C 13/04 137/461 |
| 3,262,280 | A * | 7/1966 | Chaney | F17C 13/021 62/49.2 |
| 3,292,383 | A * | 12/1966 | Pierre | B01D 19/0063 62/50.5 |
| 5,036,661 | A * | 8/1991 | Gris | F17C 13/025 60/415 |
| 5,097,976 | A * | 3/1992 | Zink | B60P 3/2205 220/243 |
| 6,007,609 | A * | 12/1999 | Semerdjian | F17C 7/04 222/189.1 |
| 6,045,115 | A * | 4/2000 | Martin, Jr. | F16K 1/305 138/44 |
| 9,562,648 | B2 | 2/2017 | Kristola et al. | |
| 2005/0051234 | A1 * | 3/2005 | Steidl | B08B 9/00 141/234 |

(Continued)

*Primary Examiner* — Kaity V Chandler
(74) *Attorney, Agent, or Firm* — Thomas J. Lavan

(57) ABSTRACT

A system is provided. The system includes one or more of a first bellows assembly, which includes a first bellows block, a second bellows block, a first pumping bellow, and first and second seals. The first bellows assembly includes a master fluid inlet port configured to receive a fluid and route the fluid to a first coupling. The second bellows block includes a master fluid outlet port and configured to route the fluid in a pressurized state from a second coupling to the master fluid outlet port. The first pumping bellow includes first and second bellow ports, the first pumping bellow oriented between the first and second couplings and coupled to a pump configured to pressurize the fluid. The first seal is disposed between the first coupling and the first bellow port and the second seal is disposed between the second coupling and the second bellow port.

5 Claims, 12 Drawing Sheets

*Fluid Flow Using Double Seals Block Diagram*

(56) References Cited

U.S. PATENT DOCUMENTS

| | | | | |
|---|---|---|---|---|
| 2015/0184645 | A1* | 7/2015 | Johnson | F17C 7/02<br>62/45.1 |
| 2015/0276131 | A1* | 10/2015 | Mori | F25D 3/10<br>62/50.7 |

* cited by examiner

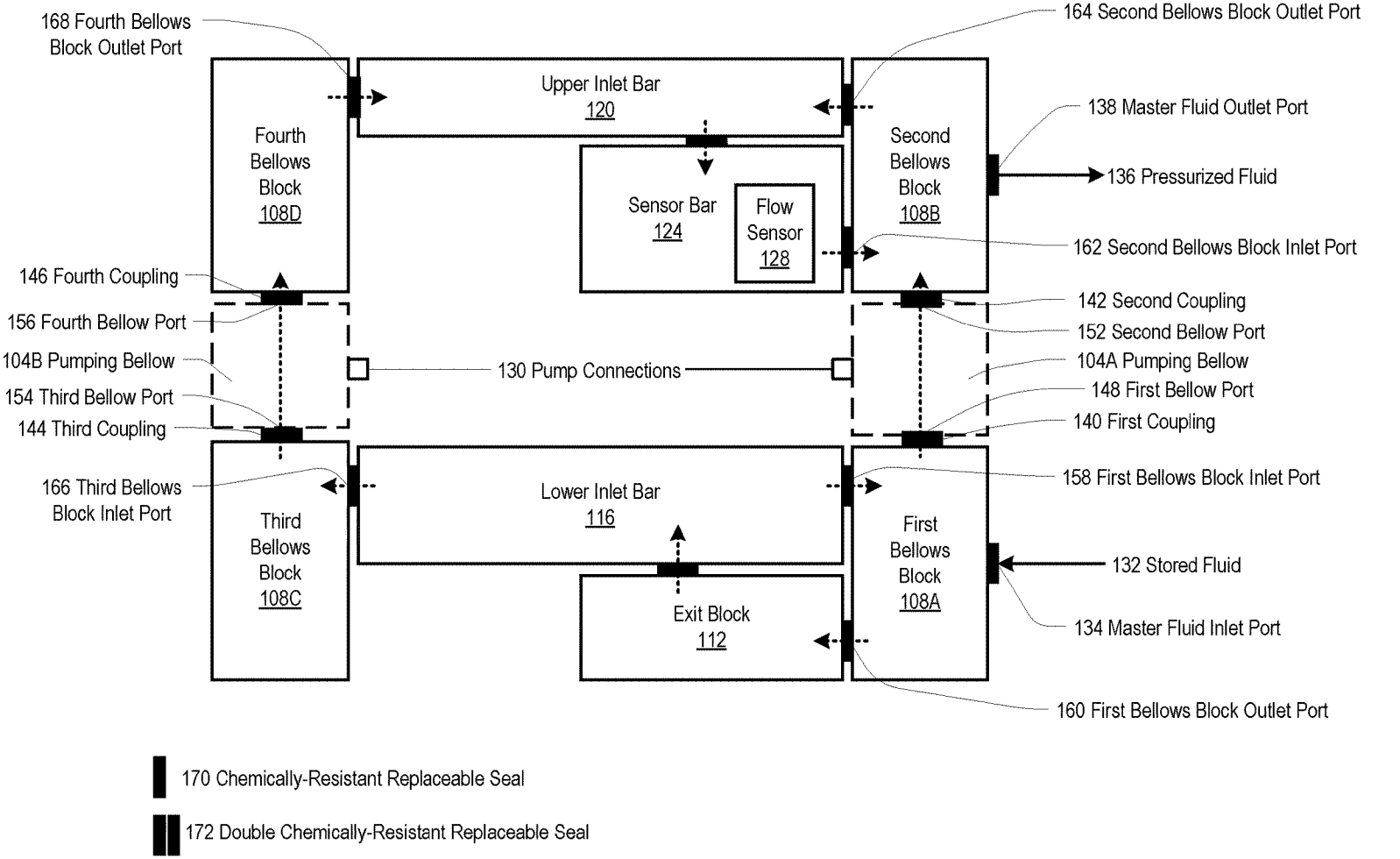
*Fig. 1A Fluid Flow Using Single Seals Block Diagram*

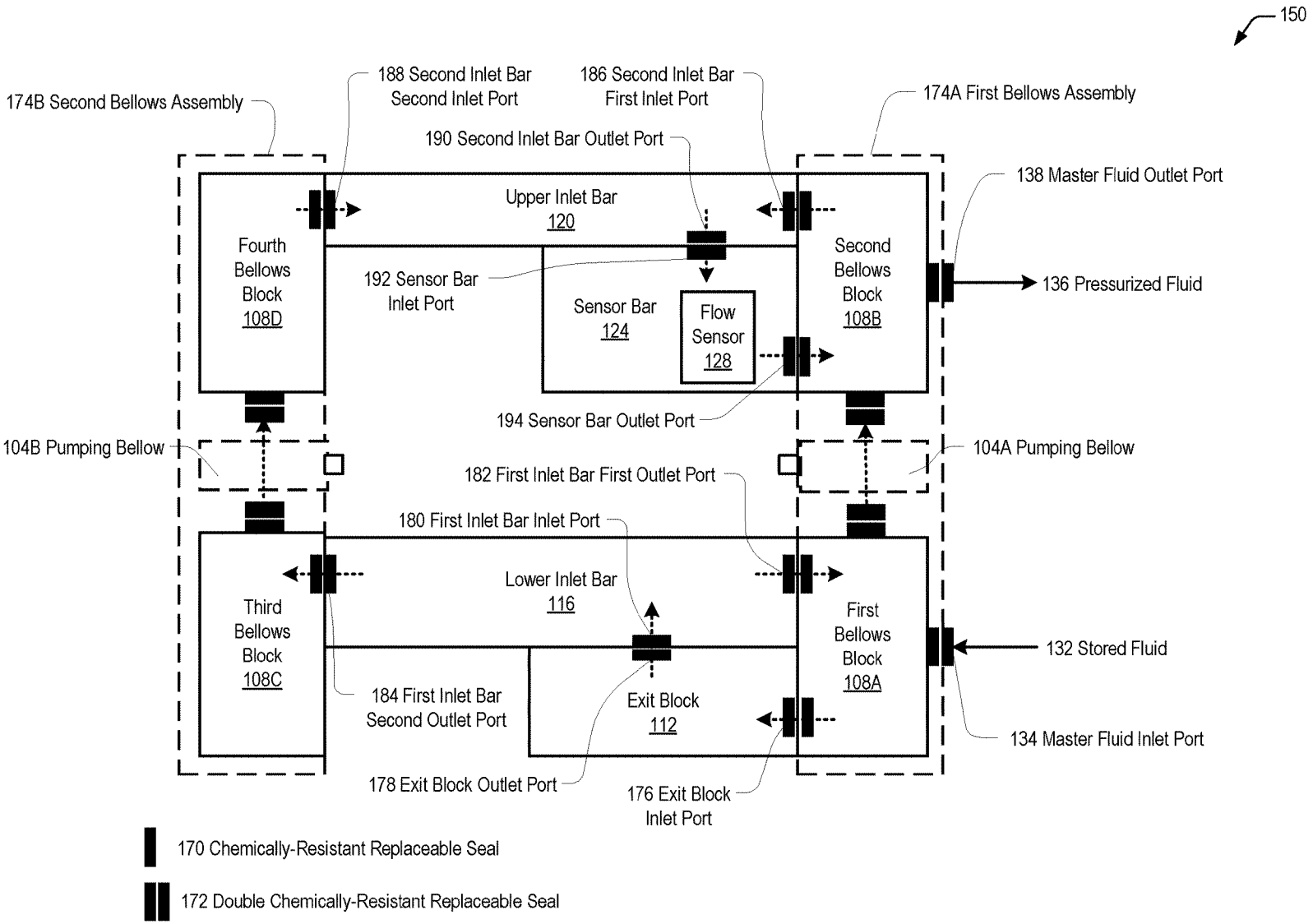
*Fig. 1B Fluid Flow Using Double Seals Block Diagram*

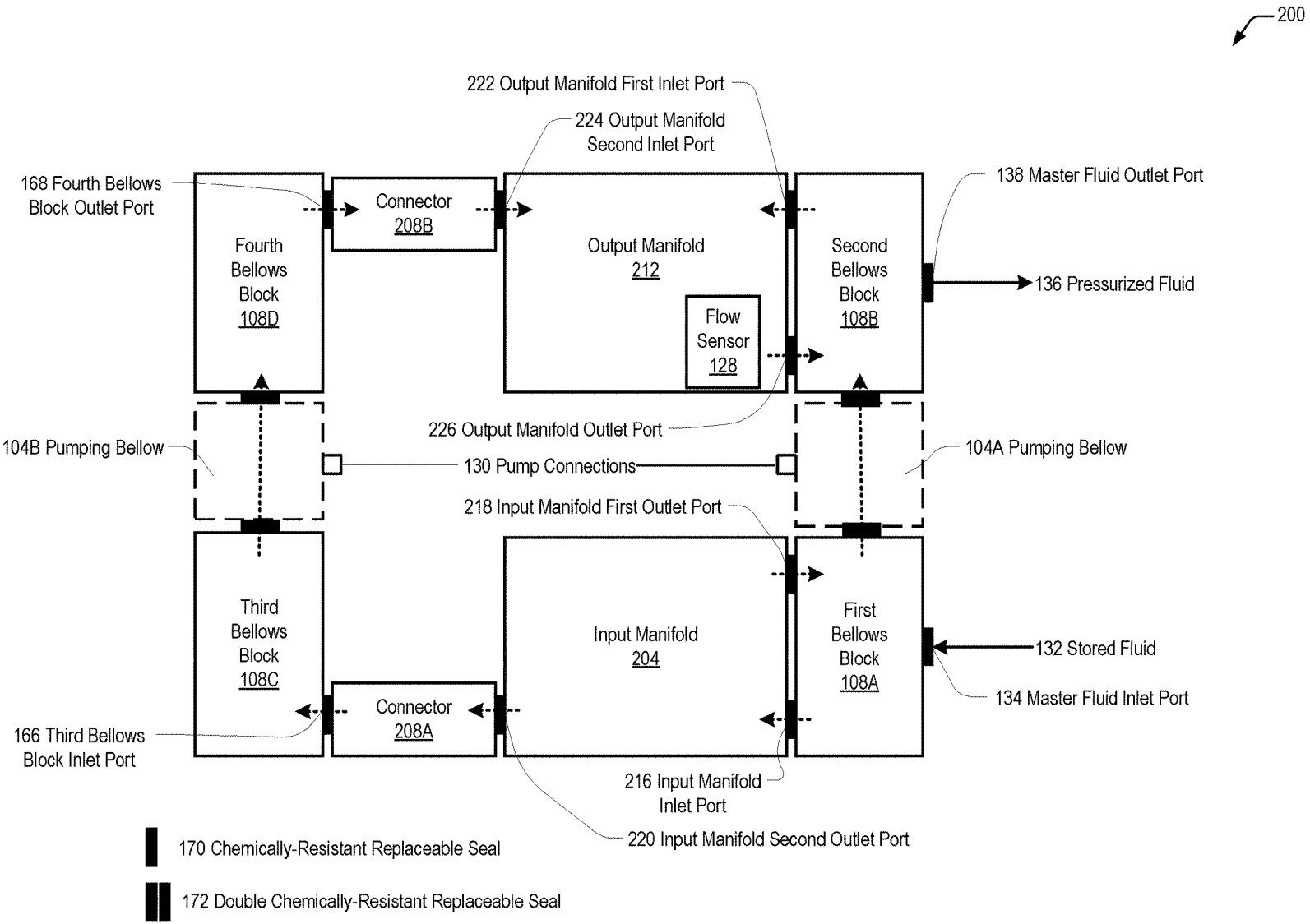
*Fig. 2A Fluid Flow Using Single Seals Block Diagram*

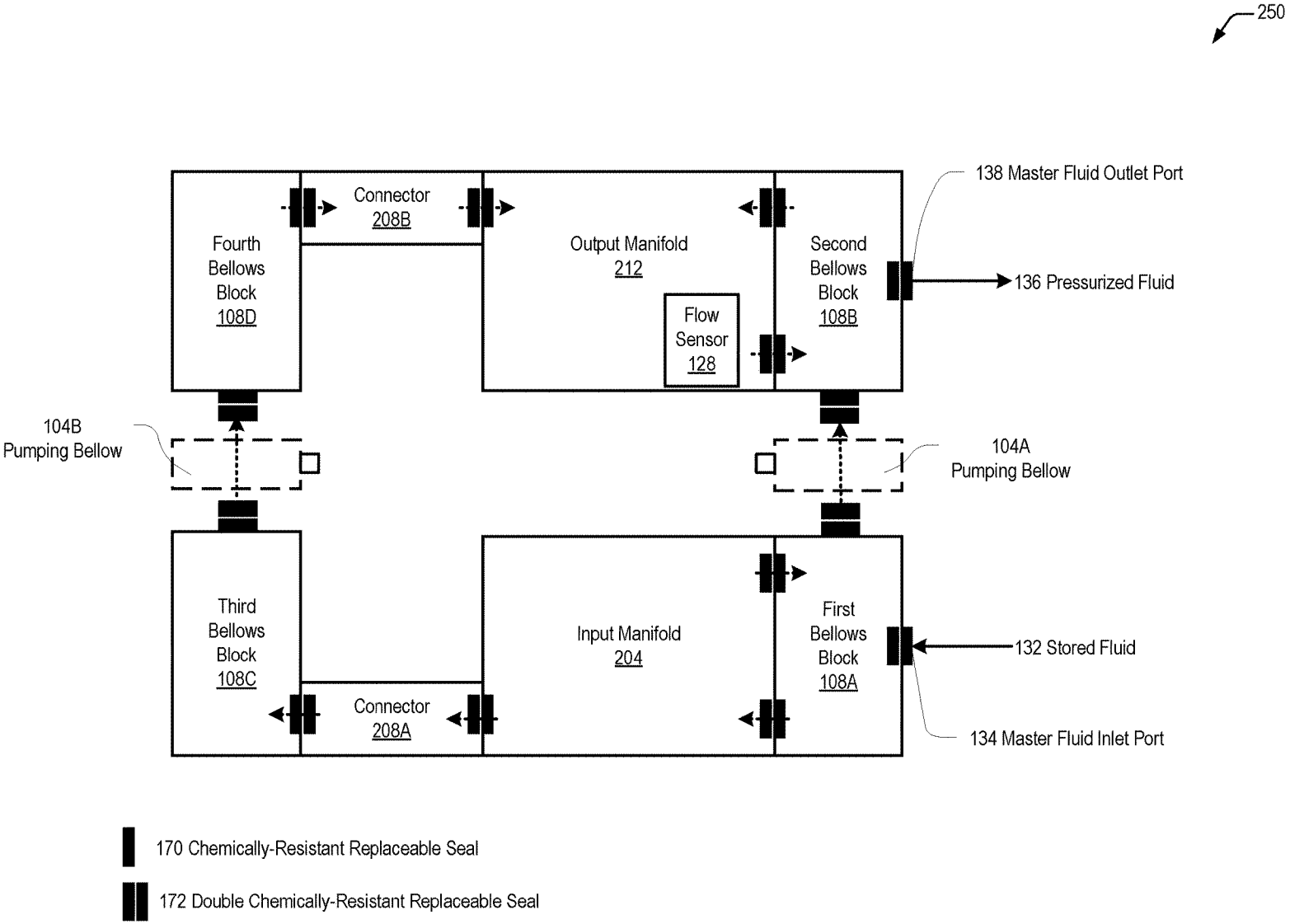
*Fig. 2B Fluid Flow Using Double Seals Block Diagram*

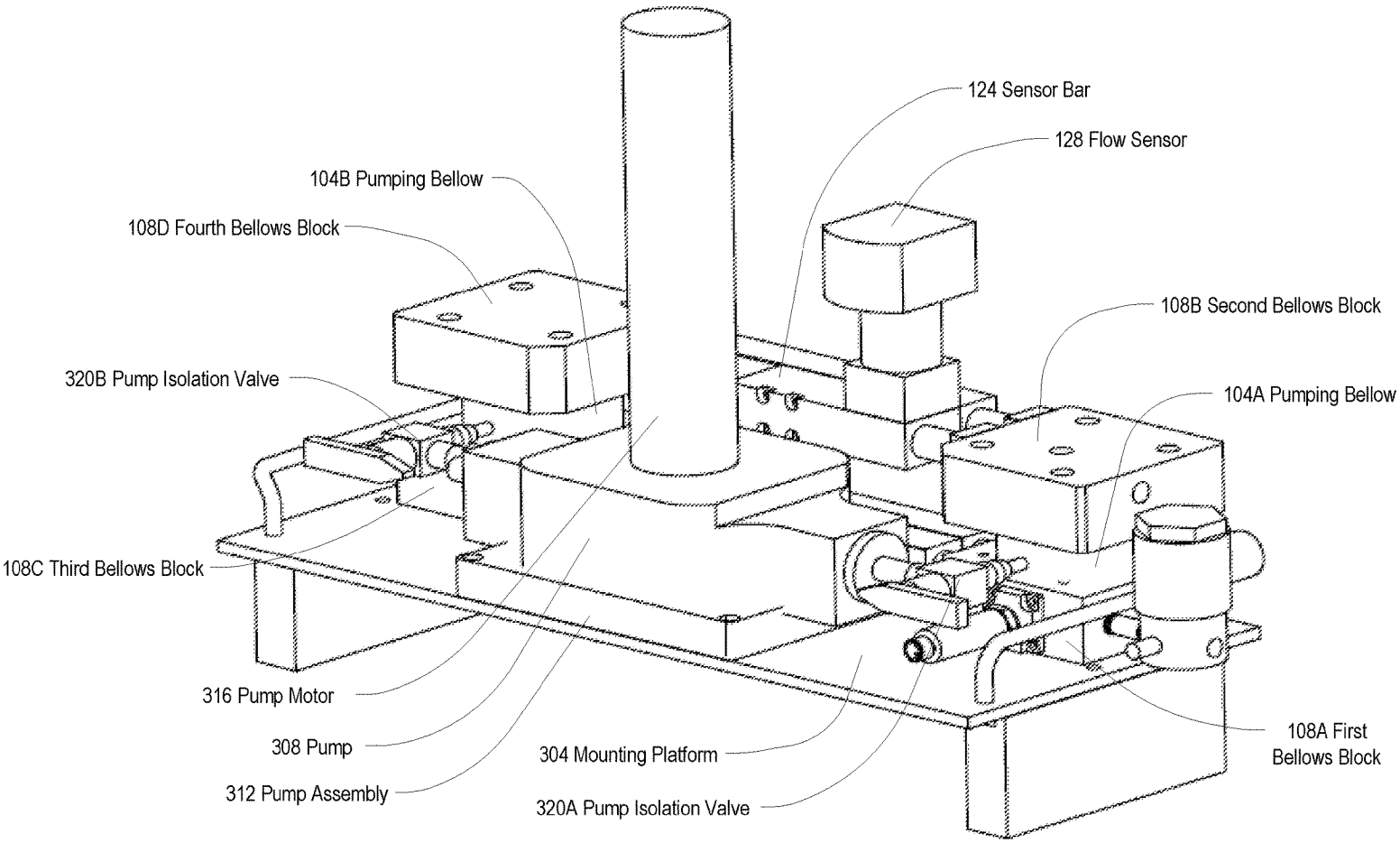
*Fig. 3A Fluid Transfer System of First Embodiment*

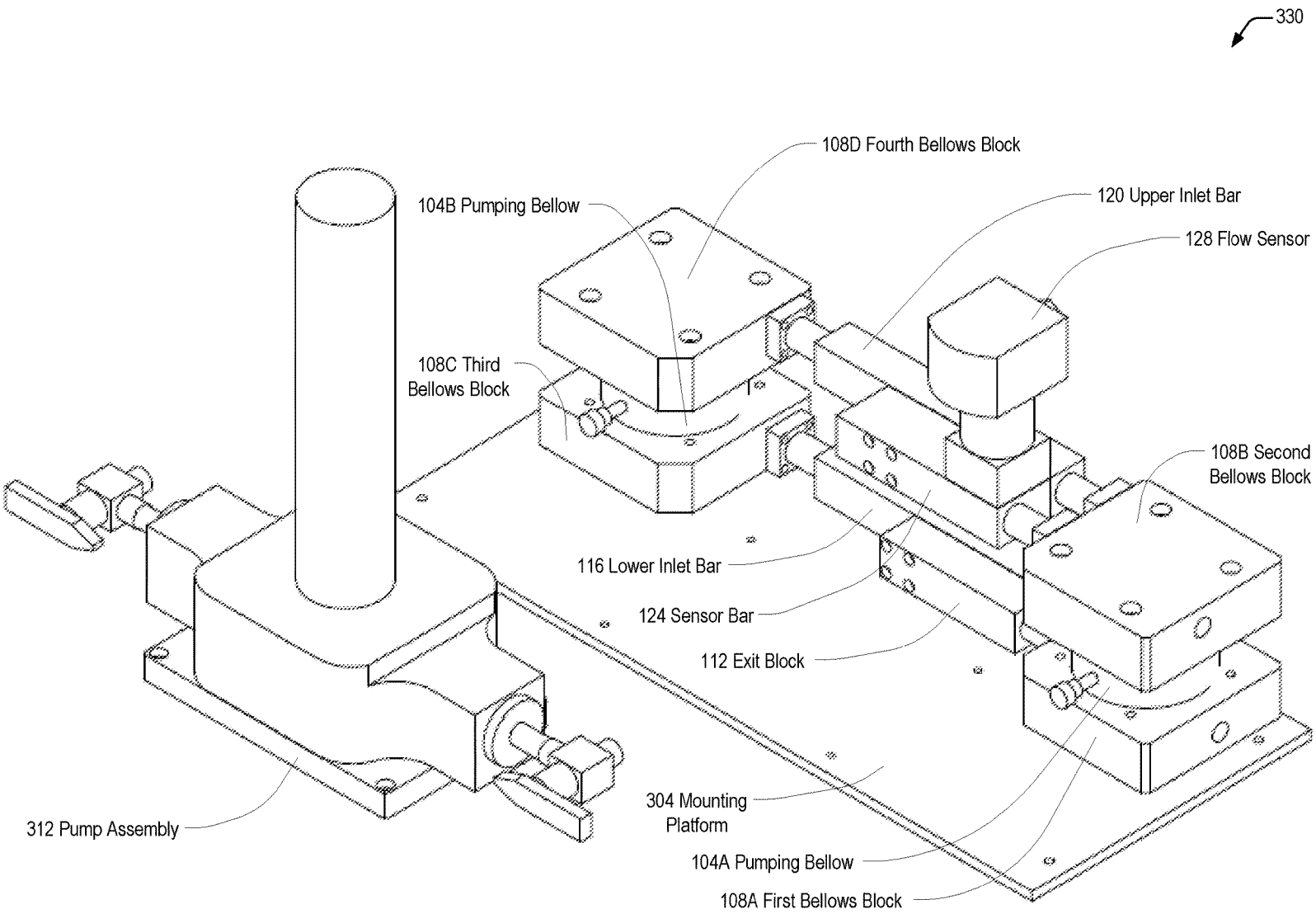
*Fig. 3B Fluid Transfer System With Separated Pump Assembly of First Embodiment*

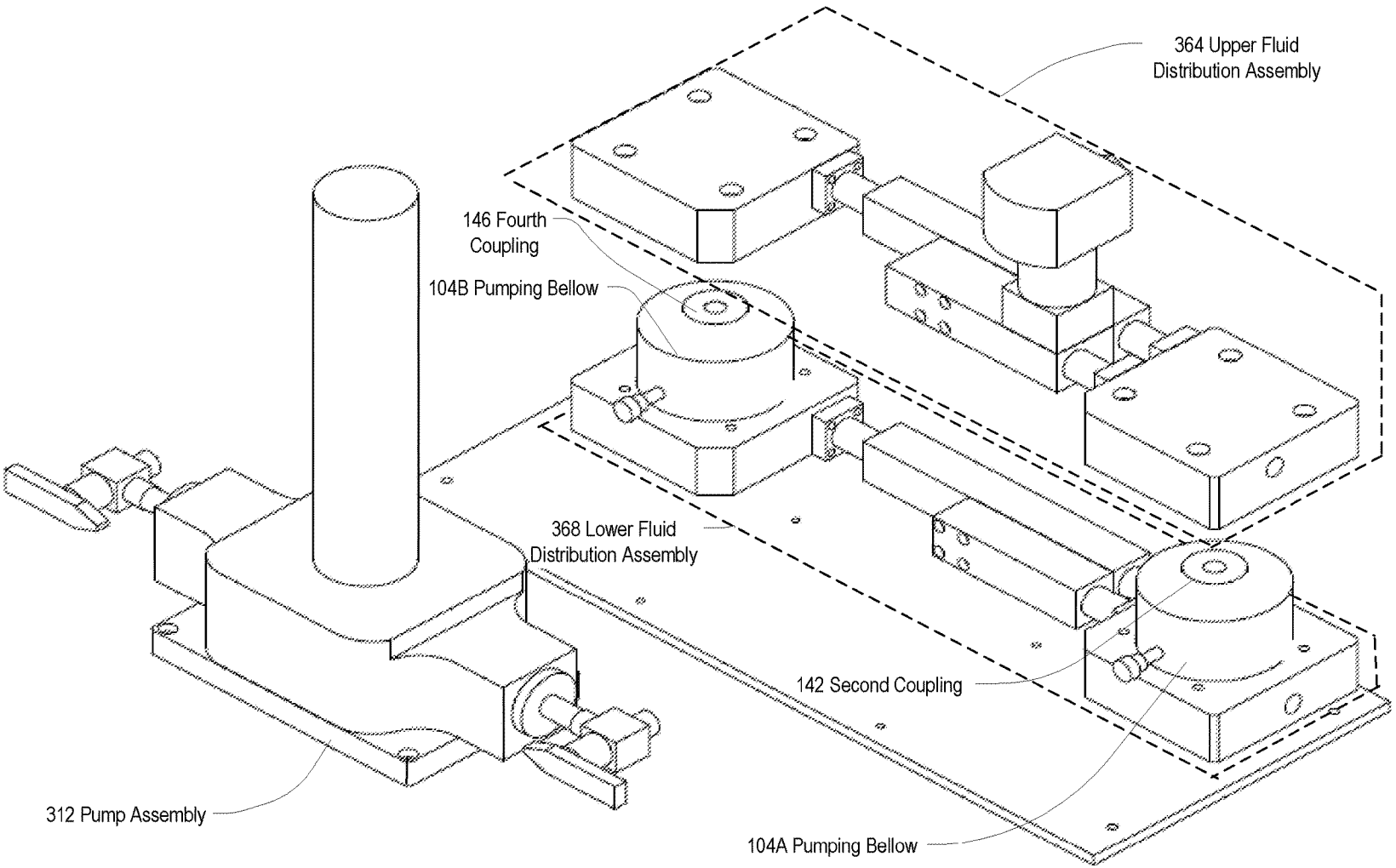
*Fig. 3C Fluid Transfer System With Separated Upper and Lower Distribution Assemblies of First Embodiment*

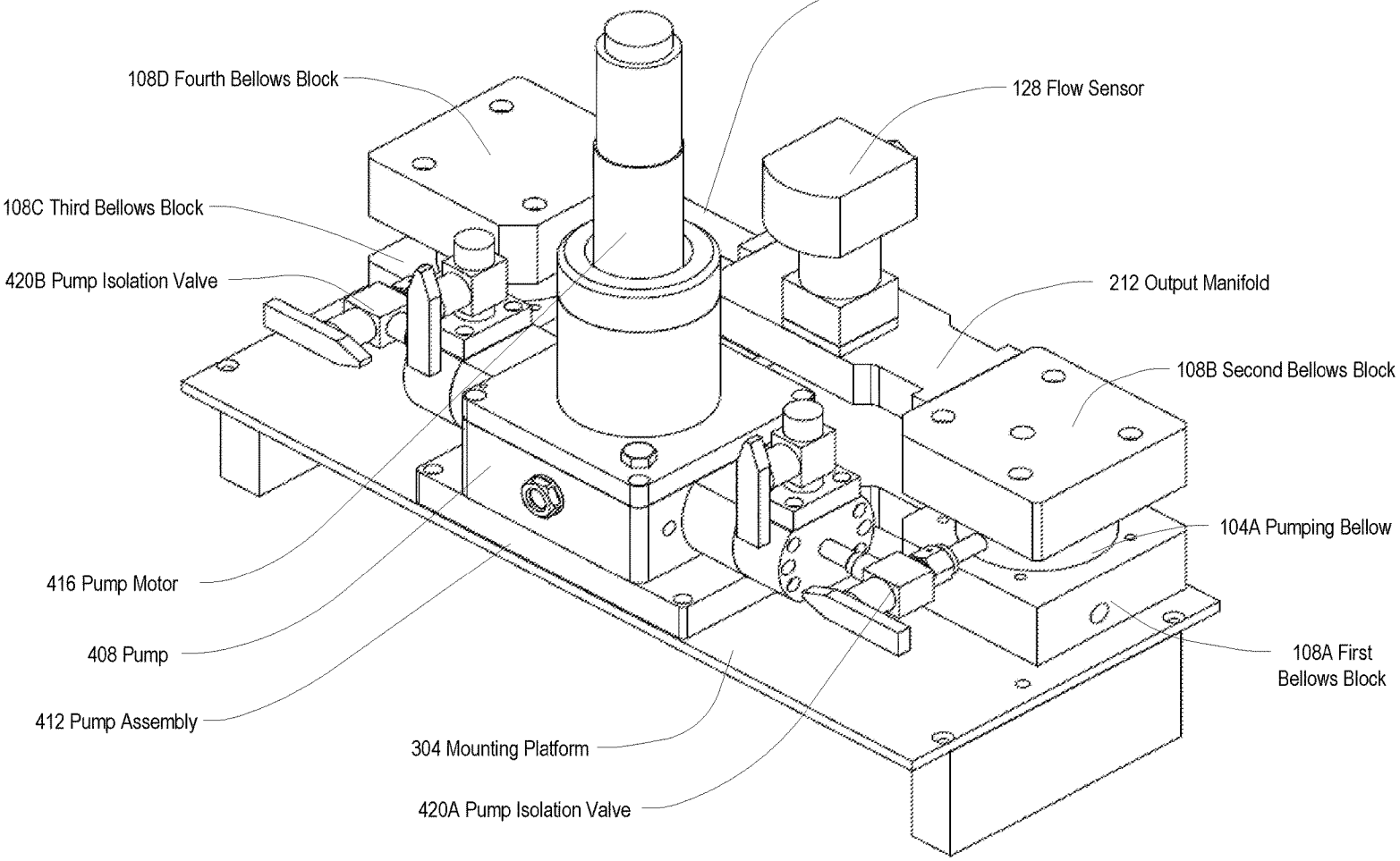
*Fig. 4A Fluid Transfer System of Second Embodiment*

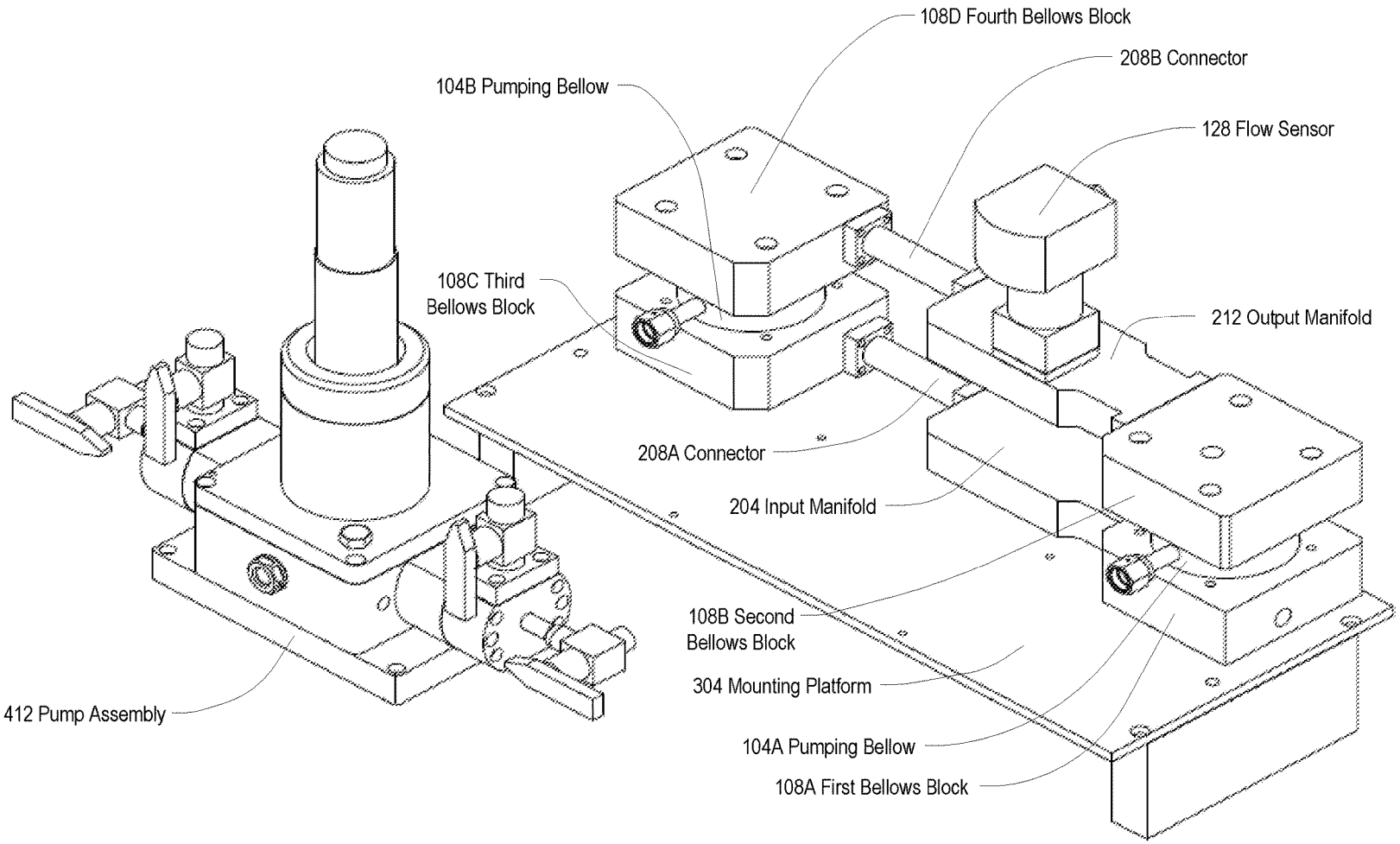
*Fig. 4B Fluid Transfer System With Separated Pump Assembly of Second Embodiment*

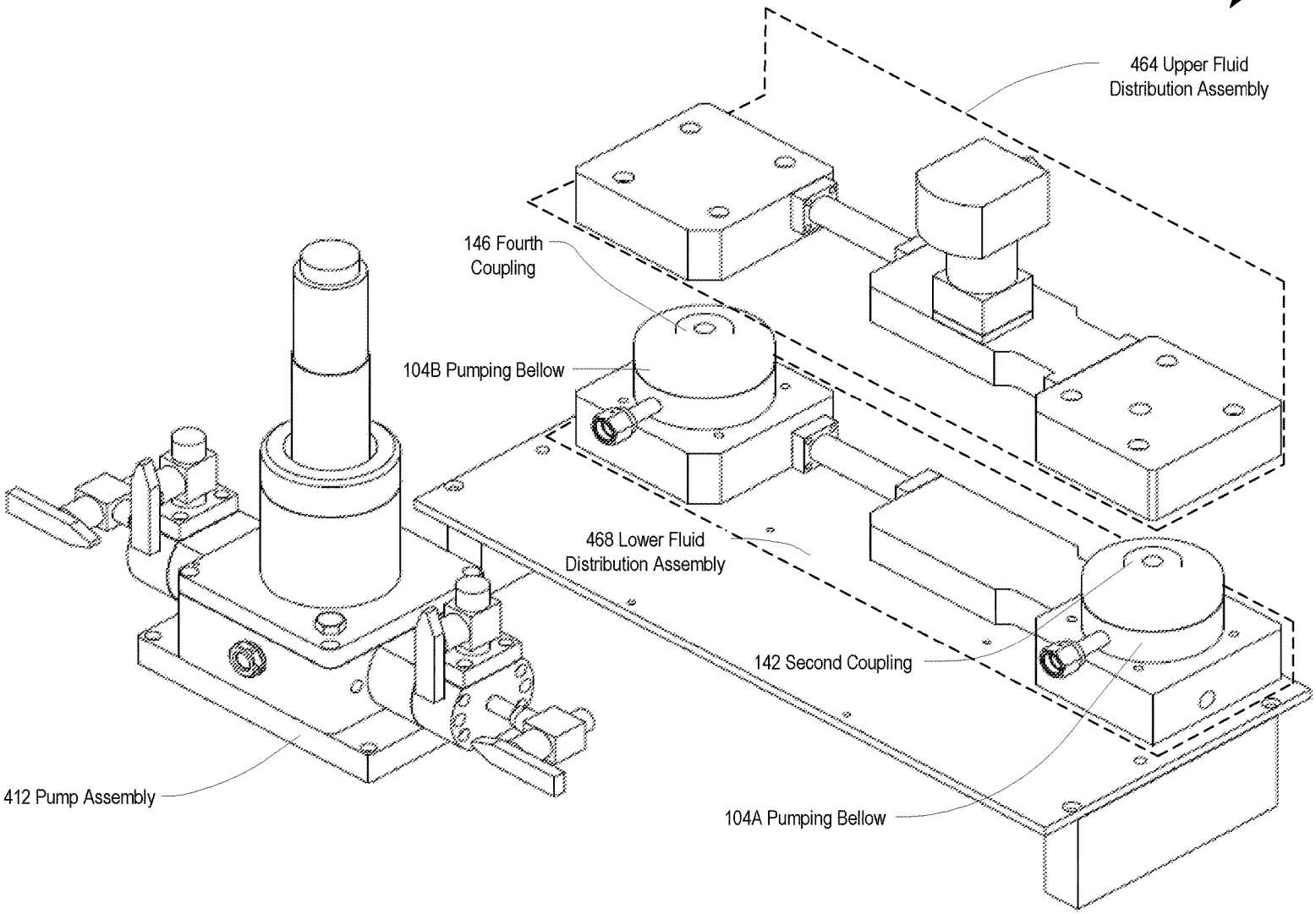
*Fig. 4C Fluid Transfer System With Separated Upper and Lower Distribution Assemblies of Second Embodiment*

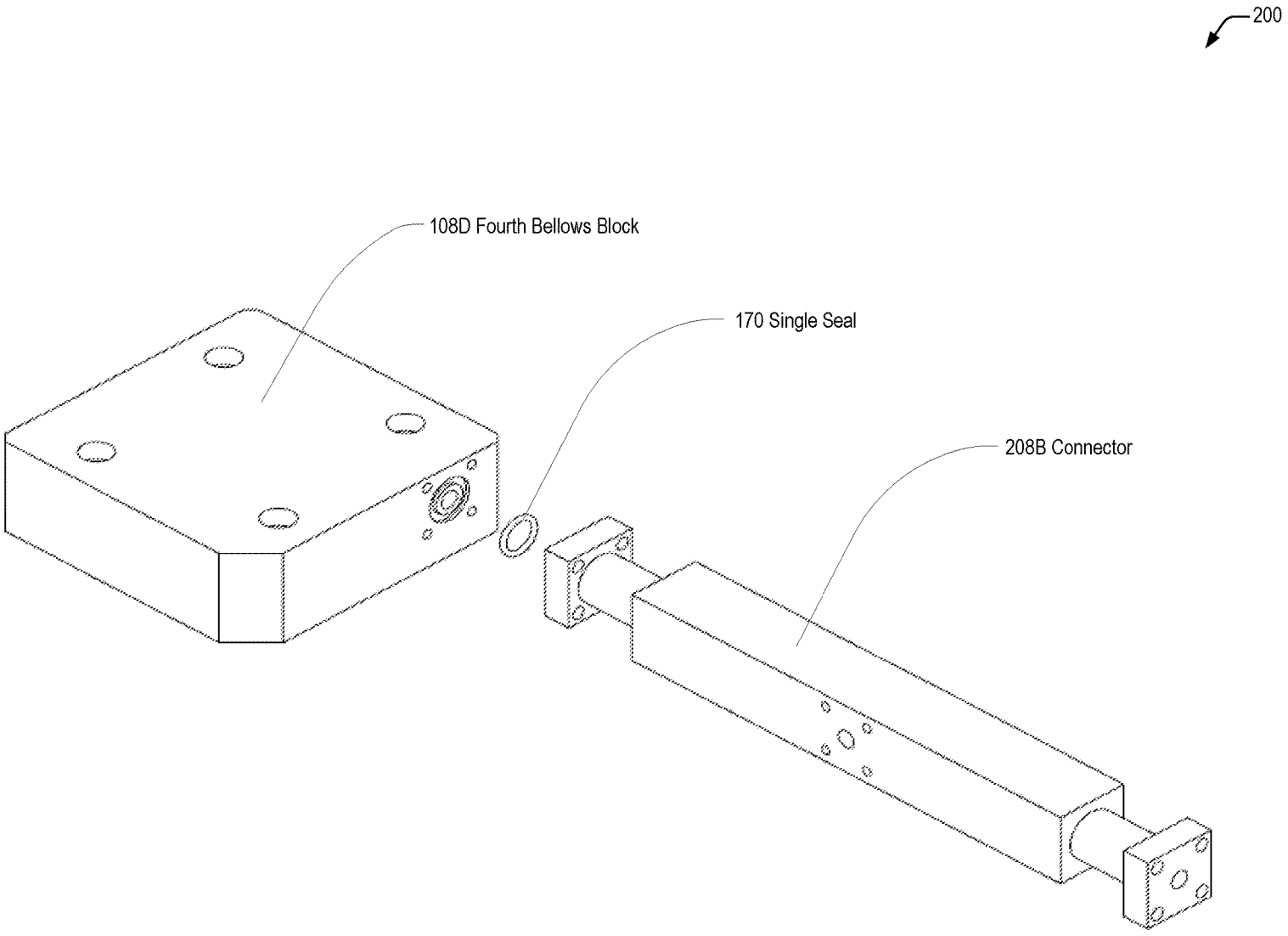
*Fig. 5A Single Seal Connection*

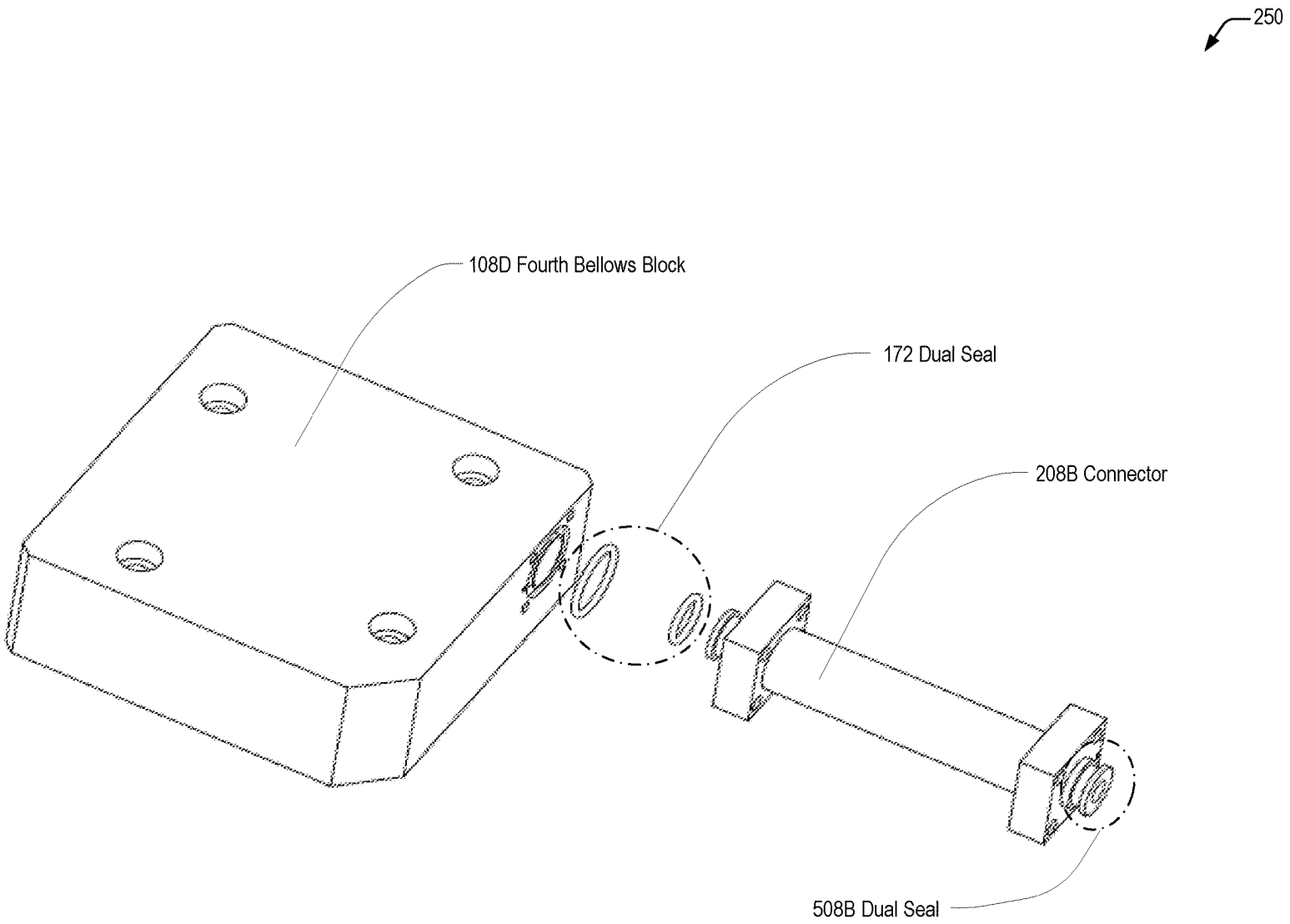
*Fig. 5B Dual Seal Connection*

SEALED MODULAR FLUID DISTRIBUTION SYSTEM

CROSS REFERENCE TO RELATED APPLICATION(S)

This application claims priority to earlier filed provisional application No. 62/492,481 filed May 1, 2017 and entitled "SEALED MODULAR FLUID DISTRIBUTION SYSTEM", the entire contents of which are hereby incorporated by reference.

FIELD

The present invention is directed to sealed modular fluid distribution systems for pressurizing chemicals and fluids for distribution in natural gas.

BACKGROUND

There are many instances in which it is desirable to inject chemicals of various types into fluids (gas and liquids) flowing in pipelines. One such example is in the area of natural gas pipelines. In addition to such substances as corrosion inhibitors and alcohol to inhibit freezing, odorants are commonly injected into natural gas pipelines. Natural gas is colorless and odorless. Odorant is injected into natural gas in order to provide a warning smell for workers and consumers. Commonly used odorants include tertiary butyl mercaptan (TBM). Such odorants are typically injected in relatively small volumes normally ranging from about 0.5 to 1.0 lbs/mmscf.

The odorants are typically provided in liquid form and are typically added to the gas at a location where distribution gas is taken from a main gas pipeline and provided to a distribution pipeline. In such circumstances, the gas pressure may be stepped down through a regulator from, for example, 600 psi or more, to a lower pressure in the range of 100 psi or less. The odorants can also be added to the main transmission pipeline in some situations.

As can be seen above, the odorants which are added to natural gas are extremely concentrated. Odorants such as TBM and other blends are mildly corrosive and are also very noxious. If the injecting odorant into distribution pipelines is not performed accurately, lives are sometimes endangered. It would be possible for a homeowner to have a gas leak without it being realized until an explosion had resulted if the proper amount of odorant was not present. Also, if a leak of odorant occurs at an injection site, people in the surrounding area may assume that a gas leak has occurred even though natural gas may not be physically present. This may result in areas being evacuated and commerce being interrupted. Contrarily, if such mistakes become common, people in the surrounding area may become desensitized to the smell of a potential gas leak and may fail to report legitimate leaks.

Two techniques are commonly used for providing odorization to natural gas in distribution pipelines. One technique involves bypassing a small amount of natural gas at a slightly higher pressure than the pressure of the main distribution pipeline, through a tank containing liquid odorant. This bypass gas absorbs relatively high concentrations of odorant while it is in the tank. This heavily odorized bypass gas is then placed back into the main pipeline. The odorant, now volatilized, diffuses throughout the pipeline. However, there are a number of disadvantages associated with the bypass system for odorizing pipelines. One disadvantage of the bypass system is the fact that the bypass gas picks up large and inconsistent amounts of odorant from the liquid in the storage tank and becomes completely saturated with odorant gas. As a result, it is necessary to carefully monitor the small amounts of bypass gas which are used. Also, natural gas streams typically have contaminates such as compressor oils or condensates which can fall out into the odorant vessel in bypass systems. These contaminates create a layer that reduces the contact area between the liquid and the bypass stream. This necessarily degrades the absorption rate of the stream failing to accurately measure and control the amount of odorant being added to the stream. This absorption amount can change as condensates and other contaminates fall out and change the absorption boundary layer.

Another technique involves the injection of liquid odorant directly into the pipeline through the use of a high-pressure injection pump. High-volume odorizers have depended on a traditional positive-displacement pump or solenoid valve to deliver discrete doses of odorant to natural gas or liquid propane gas (LPG) streams for the purpose of bringing these streams to safe perception levels. However, injecting discrete doses in this manner results in higher pressure drops due to the higher piston speed. The higher the piston speed, the more likely the odorant will vaporize and the more likely entrainment of gas. Such vapor lock is detrimental to the performance and accuracy of odorant injection systems. These methods can leave dangerous dead time between doses. Because odorant is extremely volatile, drops injected to the pipeline immediately disperse and spread throughout the gas in the pipeline. In this way, within a few seconds, the drops of liquid odorant are dispersed in gaseous form.

SUMMARY

The present invention is directed to solving disadvantages of the prior art. In accordance with embodiments of the present invention, a system is provided. The system includes one or more of a first bellows assembly, which includes a first bellows block, a second bellows block, a first pumping bellow, and first and second seals. The first bellows block includes a master fluid inlet port configured to receive a fluid from a storage tank and route the fluid to a first coupling. The second bellows block includes a master fluid outlet port and is configured to route the fluid in a pressurized state from a second coupling to the master fluid outlet port. The master fluid output port is configured to deliver the fluid in the pressurized state to a gas distribution network. The first pumping bellow includes a first bellow port and a second bellow port. The first pumping bellow is oriented between the first and second couplings and is coupled to one or more pumps configured to cause the first pumping bellow to pressurize the fluid to the pressurized state. The first seal is disposed between the first coupling and the first bellow port and the second seal is disposed between the second coupling and the second bellow port.

In accordance with another embodiment of the present invention, a system is provided. The system includes one or more of a plurality of bellow assemblies, an input manifold, an output manifold, and a plurality of seals. Each of the one or more bellow assemblies includes a first bellows block, a second bellows block, and a pumping bellow including a first bellow port and a second bellow port. The pumping bellow is disposed between the first and second bellows blocks and is coupled to one or more pumps configured to cause the pumping bellow to pressurize a fluid to a pressurized state. The input manifold is disposed between the first bellows blocks of the plurality of bellow assemblies and is configured to route the fluid between the first bellows blocks. One first bellows block of the plurality of bellow assemblies includes a master fluid inlet port configured to receive the fluid from a storage tank and route the fluid to the input manifold. The output manifold is disposed between the second bellows blocks of the plurality of bellow assemblies and is configured to route the fluid between the second bellows blocks. One second bellows block of the plurality of bellow assemblies includes a master fluid outlet port and is configured to route the fluid in the pressurized state from the second bellows blocks to the master fluid outlet port. The master fluid output port is configured to deliver the fluid in the pressurized state to a gas distribution network. The plurality of seals is disposed along fluid transfer pathways at seal locations including between the first and second bellows blocks and the pumping bellow, between each of the first bellows blocks and the input manifold, and between each of the second bellows blocks and the output manifold.

In accordance with yet another embodiment of the present invention, a system is provided. The system includes one or more of a mounting platform, one or more bellow assemblies, coupled to the mounting platform, an input manifold, an output manifold, and a plurality of chemically-resistant replaceable seals. Each of the one or more bellow assemblies includes a lower bellows block, configured to receive a fluid at a lower pressure, a pumping bellow, configured to receive the fluid at a lower pressure from the lowers bellows block and pressurize the fluid to a higher pressure, and an upper bellows block, configured to receive the fluid at a higher pressure from the pumping bellow. The input manifold is coupled to each of the lower bellows blocks and is configured to receive the fluid at a lower pressure and distribute the fluid to each of the lower bellows blocks. The output manifold is coupled to each of the upper bellows blocks and is configured to receive the fluid at a higher pressure and distribute the fluid to each of the upper bellows blocks. The plurality of chemically-resistant replaceable seals are disposed between the pumping bellows and the bellows blocks, between the input manifold and each of the lower bellows blocks, and between the output manifold and each of the upper bellows blocks.

One advantage of the present invention is that it provides a reliable sealed fluid pressurization system usable for high-pressure fluid distribution environments. Conventional fluid distribution systems use steel tubing with compression fittings. Gas distribution pipelines generally require fluid pressurization of 60-1480 psi, and may in the future require higher pressures. By replacing unreliable steel tubing and compression fittings with machined blocks and bars and chemically-resistant seals, a more reliable fluid distribution system is provided that will be more reliable at higher pressures.

One advantage of the present invention is that it provides a modular system to reliably service fluid distribution systems. For example, conventional fluid distribution systems are built with piecewise construction within a cabinet based on steel tubing and compression fittings. Removing such a system for servicing or replacement requires complete disassembly of all parts individually from the cabinet. The present fluid distribution system is modularly constructed on a removable mounting platform such that the entire fluid distribution system and pump assembly may be removed and installed as a unit within a cabinet.

Another advantage of the present invention is that it provides for double seals at each seal location. Although single seals are more reliable than compression fittings on their own, double seals result in a truly leak-proof system with greater long-term leak reliability.

Yet another advantage of the present invention is it allows for one to any number of bellow assemblies. This may reduce costs for small gas distribution networks, or increase the volume of pressurized fluid available for very large gas distribution networks, or even multiple gas distribution networks. This type of scalability is new to odorizer fluid distribution systems.

Additional features and advantages of embodiments of the present invention will become more readily apparent from the following description, particularly when taken together with the accompanying drawings. This overview is provided to introduce a selection of concepts in a simplified form that are further described below in the detailed description. It may be understood that this overview is not intended to identify key features or essential features of the claimed subject matter, nor is it intended to be used to limit the scope of the claimed subject matter.

BRIEF DESCRIPTION OF THE DRAWINGS

FIG. 1A is a block diagram illustrating fluid flow using single seals in accordance with a first embodiment of the present invention.

FIG. 1B is a block diagram illustrating fluid flow using double seals in accordance with a first embodiment of the present invention.

FIG. 2A is a block diagram illustrating fluid flow using single seals in accordance with a second embodiment of the present invention.

FIG. 2B is a block diagram illustrating fluid flow using double seals in accordance with a second embodiment of the present invention.

FIG. 3A is a diagram illustrating an isometric view of a fluid transfer system in accordance with a first embodiment of the present invention.

FIG. 3B is a diagram illustrating an isometric view of a fluid transfer system with a separated pump assembly in accordance with a first embodiment of the present invention.

FIG. 3C is a diagram illustrating an isometric view of a fluid transfer system with separated upper and lower distribution assemblies in accordance with a first embodiment of the present invention.

FIG. 4A is a diagram illustrating an isometric view of a fluid transfer system in accordance with a second embodiment of the present invention.

FIG. 4B is a diagram illustrating an isometric view of a fluid transfer system with a separated pump assembly in accordance with a second embodiment of the present invention.

FIG. 4C is a diagram illustrating an isometric view of a fluid transfer system with separated upper and lower distribution assemblies in accordance with a second embodiment of the present invention.

FIG. 5A is a diagram illustrating a single seal connection in accordance with embodiments of the present invention.

FIG. 5B is a diagram illustrating dual seal connections in accordance with embodiments of the present invention.

DETAILED DESCRIPTION

The present invention provides a chemical or fluid distribution system that provides improved fluid containment reliability over conventional systems. Conventional systems often provide compression fittings between the various blocks, bars, and pumping mechanisms. While compression fittings may be low in cost and easy to manufacture, they effectively create unserviceable connections since they may only be reliably made one time. Additionally, compression fittings generally provide only one layer of seal protection, such that if a compression fitting weakens or fails, fluid may leak from a fluid distribution system.

For safety reasons, in order for humans to be able to detect the presence of natural gas, an odorizing agent is added to the natural gas. In most embodiments, the odorizing agent is Mercaptan (also known as Thiol). Mercaptan is in a class of organic compounds in which the oxygen of an alcohol has been replaced by sulfur and which have distinctive, often disagreeable, odors. The present application describes a fluid distribution system where a fluid, such as Mercaptan, is pressurized to a predetermined range of pressure, metered, and distributed within a natural gas distribution system. Once added to pipelines, the fluid diffuses throughout the natural gas to a desired lower concentration. The lower concentration is known to be detected by humans while not making a detection area uninhabitable due only to smell.

Before the fluid is added to a gas distribution network or liquefied petroleum gas network, it is in extremely high concentrations. Because of this, it is important to ensure the fluid distribution system does not leak fluid at any time. Additionally, if one smells the fluid they will at least suspect a natural gas leak since the smell of Mercaptan diffused in natural gas is well known. However, the fluid distribution system does not actually handle or interface directly with natural gas. Therefore, a fluid or Mercaptan leak is likely to be wrongly interpreted as a natural gas leak—which is a serious safety hazard due to explosion risk.

The present invention advantageously prevents fluid leaks in fluid distribution systems and offers a high degree of field serviceability over conventional systems. Both single and dual seal embodiments are described, using seals having improved reliability and effectiveness over conventional compression seals. When conventional systems experience fluid leaks, they must be disassembled in the field and taken to a repair facility or depot to repair faulty, damaged, or old tubing or seals. Once disassembled, old compression seals may not be re-used since they have a failure rate of close to 50% when re-used. The seals (including face seals) described herein allow the complete fluid distribution system to be modularly removed and repaired, without complete or near-complete disassembly. This greatly increases serviceability over the life of the fluid distribution system.

Referring now to FIG. 1A, a block diagram illustrating fluid flow using single seals in accordance with a first embodiment of the present invention is shown. FIG. 1A illustrates a seal arrangement for a first embodiment of a chemical or fluid distribution system 100. The heart of the fluid distribution system 100 is one or more pumping bellows 104, which pressurize a given volume of fluid to a pressure determined by a pump attached to pump connections 130. A hydraulic or pneumatic pump 308, which is part of a pump assembly 312, is attached to the pump connections 130. The hydraulic or pneumatic pump 308 energizes each of the pumping bellows 104A, 104B through hydraulic fluid or other means, and in some embodiments is regulated by flow sensor data from a flow sensor 128. A computing device (not shown) may receive the flow sensor data and use the data to regulate the pumping bellows 104 through the pump 308. In the embodiment illustrated, there are two pumping bellows 104 shown, identified as pumping bellow 104A and 104B. It should be understood that a fluid distribution system 100 may include any number of pumping bellows 104, but must include at least one. The hydraulic or pneumatic pump 308 energizes each of the pumping bellows 104 in a coordinated fashion, in order to provide a required volume of pressurized fluid at a required pressure. Although current gas distribution networks operate from low pressures up to 1480 psi, it is anticipated that future networks may require higher pressures. The fluid distribution systems described herein have been successfully tested to over 2,000 psi.

The fluid distribution system 100 receives stored fluid 132 from a storage tank or other vessel at a low pressure (10-50 psi), through a master fluid inlet port 134. The master fluid inlet port 134 may be located on a first bellows block 108A. For a fluid distribution system 100 including only a single pumping bellow 104A, the first bellows block 108A routes the fluid 132 from the master fluid inlet port 134 to a first coupling 140. The first coupling 140 includes a chemically-resistant replaceable seal 170, and provides a leak-proof interface to the pumping bellow 104A. For a fluid distribution system 100 including multiple pumping bellows 104, the first bellows block 108A instead routes the fluid 132 from the master fluid inlet port 134 to a first bellows block outlet port 160 through a single chemically-resistant replaceable seal 170. The first bellows block 108A also receives low-pressure fluid 132 through a first bellows block inlet port 158 including a single chemically-resistant replaceable seal 170 and provides the fluid 132 to the first coupling 140. The first coupling 140 includes a chemically-resistant replaceable seal 170, and provides a leak-proof interface to the pumping bellow 104A. Pumping bellow 104A includes a first bellow port 148 and a second bellow port 152.

For fluid distribution systems 100 including multiple pumping bellows 104, the system 100 includes a low-pressure fluid distribution manifold to distribute the fluid 132 equally to each of the pumping bellows 104. Although two pumping bellows 104A, 104B are illustrated herein, it should be understood that the fluid distribution system 100 may include any number (but at least one) of pumping bellows 104 or pumping bellow assemblies. In the illustrated embodiment, the low-pressure fluid distribution manifold includes an exit block 112, a first or lower inlet bar 116, and associated seals 170 between each of the blocks and bars. An exit block 112 receives low-pressure fluid 132 from the first bellows block 108A and routes the fluid 132 to the lower inlet bar 116. The lower inlet bar 116 receives the low-pressure fluid 132 from the exit block 112, and routes the fluid 132 to two or more bellows blocks 108 on the low pressure side of each of the pumping bellows 104A, 104B. In the embodiment illustrated, the first or lower inlet bar 116 distributes the fluid 132 to the first bellows block 108A and the third bellows block 108C through single chemically-resistant replaceable seals 170.

The third bellows block 108C receives low-pressure fluid 132 through a third bellows block inlet port 166 including a single chemically-resistant replaceable seal 170 and provides the fluid to a third coupling 144. The third coupling 144 includes a chemically-resistant replaceable seal 170, and provides a leak-proof interface to the pumping bellow 104B. Pumping bellow 104B includes a third bellow port 154 and a fourth bellow port 156.

Pumping bellow 104A delivers pressurized fluid 136 to a second bellows block 108B through a second coupling 142. The second coupling 142 includes a chemically-resistant replaceable seal 170, and provides a leak-proof interface to the pumping bellow 104A. For a fluid distribution system 100 including a single pumping bellow 104A, the second bellows block 108B routes the pressurized fluid 136 from the second coupling 142 to a master fluid outlet port 138. For a fluid distribution system 100 including multiple pumping bellows 104A, 104B, the second bellows block 108B instead routes the fluid 136 from the second coupling 142 to a second bellows block outlet port 164. The second bellows block 108B also receives pressurized fluid 136 from a second bellows block inlet port 162 and routes the fluid 136 to the master fluid outlet port 138. The master fluid outlet port 138 provides pressurized fluid to a gas distribution pipeline or network, where the pressurized fluid 136 is diffused within natural gas.

Pumping bellow 104B delivers pressurized fluid 136 to a fourth bellows block 108D through a fourth coupling 146. The fourth coupling 146 includes a chemically-resistant replaceable seal 170, and provides a leak-proof interface to the pumping bellow 104B. The fourth bellows block 108D routes the fluid 136 from the fourth coupling 146 to a fourth bellows block outlet port 168.

For fluid distribution systems 100 including multiple pumping bellows 104, the system 100 includes a high-pressure fluid distribution manifold to distribute the pressurized fluid 136 equally from each of the pumping bellows 104A, 104B. In the illustrated embodiment, the high-pressure fluid distribution manifold includes a second or upper inlet bar 120, a sensor bar 124, and associated seals 170 between each of the blocks and bars. The upper inlet bar 120 receives pressurized fluid 136 from the second bellows block 108B and fourth bellows block 108D and routes the fluid 136 to the sensor bar 124. The sensor bar 124 receives pressurized fluid 136 from the upper inlet bar 120 and provides the fluid 136 to the second bellows block 108B. In the embodiment illustrated, a flow sensor 128 is coupled to the sensor bar 128, and provides a measurement of flow rate or pressure (psi) of the pressurized fluid 136. In other embodiments, there may be no sensors attached to the sensor bar 124, or other sensors either in place of, or in addition to, the flow sensor 128. An example of a different sensor may be a temperature, wind, or humidity sensor.

Referring now to FIG. 1B, a block diagram illustrating fluid flow using double seals in accordance with a first embodiment of the present invention is shown. FIG. 1B illustrates an alternative seal arrangement for a first embodiment of a chemical or fluid distribution system 150. The heart of the fluid distribution system 150 is one or more pumping bellows 104, which pressurize a given volume of fluid to a given pressure. A hydraulic or pneumatic pump 308, which is part of a pump assembly 312, is attached to the pump connections 130. The hydraulic or pneumatic pump 308 energizes each of the pumping bellows 104A, 104B through hydraulic fluid or other means, and in some embodiments is regulated by flow sensor data from a flow sensor 128. In the embodiment illustrated, there are two pumping bellows 104 shown, identified as pumping bellow 104A and 104B. It should be understood that a fluid distribution system 150 may include any number of pumping bellows 104, but must include at least one. The hydraulic or pneumatic pump 308 energizes each of the pumping bellows 104 in a coordinated fashion, in order to provide a required volume of pressurized fluid 136 at a required pressure.

The fluid distribution system 150 receives stored fluid 132 from a storage tank or other vessel at a low pressure (10-50 psi), through a master fluid inlet port 134. The master fluid inlet port 134 may be located on a first bellows block 108A. For a fluid distribution system 150 including a single pumping bellow 104A, the first bellows block 108A routes the fluid 132 from the master fluid inlet port 134 through a double chemically-resistant replaceable seal 172, and provides a leak-proof interface to the pumping bellow 104A. For a fluid distribution system 150 including multiple pumping bellows 104, the first bellows block 108A instead routes the fluid 132 from the master fluid inlet port 134 through a double chemically-resistant replaceable seal 170 to the exit block inlet port 176. The first bellows block 108A also receives low-pressure fluid 132 from a first inlet bar first outlet port 182 including a double chemically-resistant replaceable seal 172 and provides the fluid 132 to the pumping bellow 104A.

For fluid distribution systems 150 including multiple pumping bellows 104, the system 150 includes a low-pressure fluid distribution manifold to distribute the fluid 132 equally to each of the pumping bellows 104. In the illustrated embodiment, the low-pressure fluid distribution manifold includes an exit block 112, a lower inlet bar 116, and associated seals 172 between each of the blocks and bars. The exit block 112 receives low-pressure fluid 132 from the exit block inlet port 176 and routes the fluid 132 to the exit block outlet port 178. The lower inlet bar 116 receives the low-pressure fluid 132 through the first inlet bar inlet port 180, and routes the fluid 132 to two or more bellows blocks 108A, 108C on the low pressure side of each of the pumping bellows 104A, 104B. In the embodiment illustrated, the lower inlet bar 116 distributes the fluid 132 to the first inlet bar first outlet port 182 and first outlet bar second outlet port 184.

The third bellows block 108C receives low-pressure fluid 132 from the first inlet bar second outlet port 184 through a double chemically-resistant replaceable seal 172 and provides the fluid 132 to the pumping bellow 104B through another double chemically-resistant replaceable seal 172.

Pumping bellow 104A delivers pressurized fluid 136 through a double chemically-resistant replaceable seal 172 to the second bellows block 108B. For a fluid distribution system 150 including a single pumping bellow 104A, the second bellows block 108B routes the pressurized fluid 136 from the pumping bellow 104A to the master fluid outlet port 138. For a fluid distribution system 150 including multiple pumping bellows 104A, 104B, the second bellows block 108B instead routes the fluid 136 from the pumping bellow 104A to a second inlet bar first inlet port 186. The second bellows block 108B also receives pressurized fluid 136 from sensor bar outlet port 194 and routes the fluid 136 to the master fluid outlet port 138. The master fluid outlet port 138 provides pressurized fluid to a distribution pipeline or network, where the pressurized fluid 136 is diffused within natural gas.

Pumping bellow 104B delivers pressurized fluid 136 to the fourth bellows block 108D through a double chemically-resistant replaceable seal 172. The fourth bellows block 108D routes the fluid 136 from the pumping bellow 104B to the second inlet bar second inlet port 188.

For fluid distribution systems 150 including multiple pumping bellows 104, the system 150 includes a high-pressure fluid distribution manifold to distribute the pressurized fluid 136 equally from each of the pumping bellows 104A, 104B. In the illustrated embodiment, the high-pressure fluid distribution manifold includes an upper inlet bar 120, a sensor bar 124, and associated double seals 172 between each of the blocks and bars.

In one embodiment, the seals on each side of each pumping bellow 104A, 104B are double seals 172, while all other seals are single seals 170. In another embodiment, the seals on the high pressure side of the fluid distribution system 150 are double seals 172, while the seals on the low pressure side of the fluid distribution system 150 are single seals 170. The high pressure side of the fluid distribution system 150 includes all seals in contact with the second bellows block 108B, upper inlet bar 120, sensor bar 124, flow sensor 128, and the fourth bellows block 108D. The low pressure side of the fluid distribution system 150 includes all seals in contact with the first bellows block 108A, lower inlet bar 116, exit block 112, and the third bellows block 108C.

It should be understood that different elements are shown in different drawings herein to aid clarity. However, for similar constructions and structures, the same elements should be understood to be present. For example, although FIG. 1B does not show the fourth bellow block outlet port 168, it should be understood as present since it has the same structure as FIG. 1A.

Referring now to FIG. 2A, a block diagram illustrating fluid flow using single seals in accordance with a second embodiment of the present invention is shown. FIG. 2A illustrates a seal arrangement for a second embodiment of a chemical or fluid distribution system 200. The heart of the fluid distribution system 200 is one or more pumping bellows 104, which pressurize a given volume of fluid to a given pressure. A hydraulic or pneumatic pump 408, which is part of a pump assembly 412, is attached to the pump connections 130. The hydraulic or pneumatic pump 408 energizes each of the pumping bellows 104A, 104B through hydraulic fluid or other means, and in some embodiments is regulated by flow sensor data from a flow sensor 128. A computing device (not shown) may receive the flow sensor data and use the data to regulate the pumping bellows 104 through the pump 308. In the embodiment illustrated, there are two pumping bellows 104 shown, identified as pumping bellow 104A and 104B. It should be understood that a fluid distribution system 200 may include any number of pumping bellows 104, but must include at least one. The hydraulic or pneumatic pump 408 energizes each of the pumping bellows 104 in a coordinated fashion, in order to provide a required volume of pressurized fluid 136 at a required pressure.

The fluid distribution system 200 receives stored fluid 132 from a storage tank or other vessel at a low pressure (10-50 psi), through a master fluid inlet port 134. The master fluid inlet port 134 may be located on a first bellows block 108A. For a fluid distribution system 100 including a single pumping bellow 104A, the first bellows block 108A routes the fluid 132 from the master fluid inlet port 134 through a chemically-resistant replaceable seal 170, and provides a leak-proof interface to the pumping bellow 104A. For a fluid distribution system 200 including multiple pumping bellows 104, the first bellows block 108A instead routes the fluid 132 from the master fluid inlet port 134 through a chemically-resistant replaceable seal 172 to an input manifold inlet port 216. The first bellows block 108A also receives low-pressure fluid 132 from an input manifold first outlet port 218 including a chemically-resistant replaceable seal 170 and provides the fluid 132 to the pumping bellow 104A.

For fluid distribution systems 200 including multiple pumping bellows 104, the system 200 includes a low-pressure fluid distribution manifold to distribute the fluid 132 equally to each of the pumping bellows 104. In the illustrated embodiment, the low-pressure fluid distribution manifold includes an input manifold 204, connector 208A, and seals 170 between each of the blocks and bars. The input manifold 204 receives low-pressure fluid 132 from the input manifold inlet port 216 and routes the fluid 132 to the input manifold first outlet port 218 and the input manifold second outlet port 220. The connector 208A may be optionally required for embodiments where the distance between the input manifold second outlet port 220 and the third bellows block inlet port 166 requires a rigid connection to fill the gap.

The third bellows block 108C receives low-pressure fluid 132 from the third bellows block inlet port 166 through a chemically-resistant replaceable seal 170 and provides the fluid 132 to the pumping bellow 104B through another chemically-resistant replaceable seal 170.

Pumping bellow 104A delivers pressurized fluid 136 through a chemically-resistant replaceable seal 170 to the second bellows block 108B. For a fluid distribution system 200 including a single pumping bellow 104A, the second bellows block 108B routes the pressurized fluid 136 from the pumping bellow 104A to the master fluid outlet port 138. For a fluid distribution system 200 including multiple pumping bellows 104A, 104B, the second bellows block 108B instead routes the fluid 136 from the pumping bellows 104A to the output manifold first inlet port 222. The second bellows block 108B also receives pressurized fluid 136 from the output manifold outlet port 226 and routes the fluid 136 to the master fluid outlet port 138. The master fluid outlet port 138 provides pressurized fluid to a distribution pipeline or network, where the pressurized fluid 136 is diffused within natural gas.

Pumping bellow 104B delivers pressurized fluid 136 to the fourth bellows block 108D through a chemically-resistant replaceable seal 170. The fourth bellows block 108D routes the fluid 136 from the pumping bellow 104B to the fourth bellows block outlet port 168.

For fluid distribution systems 200 including multiple pumping bellows 104, the system 200 includes a high-pressure fluid distribution manifold to distribute the pressurized fluid 136 equally from each of the pumping bellows 104A, 104B. In the illustrated embodiment, the high-pressure fluid distribution manifold includes an output manifold 212, a connector 208B, and associated seals 170 between each of the blocks and bars. The connector 208B may be optionally required for embodiments where the distance between the output manifold second inlet port 224 and the fourth bellows block outlet port 166 requires a rigid connection to fill the gap.

It should be understood that different elements are shown in different drawings herein to aid clarity. However, for similar constructions and structures, the same elements should be understood to be present. For example, although FIG. 1B does not show the fourth bellow block outlet port 168, it should be understood as present since it has the same structure as FIG. 1A.

Referring now to FIG. 2B, a block diagram illustrating fluid flow using double seals in accordance with a second embodiment of the present invention is shown. FIG. 2B shows double seals 172 at each block or bar interface of the fluid distribution system 250, in place of the single seals 170 shown in FIG. 2A. All other ports and fluid flow described with respect to FIG. 2A are present in FIG. 2B, although not explicitly shown. In one embodiment, the seals on each side of each pumping bellow 104A, 104B are double seals 172, while all other seals are single seals 170. In another embodiment, the seals on the high pressure side of the fluid distribution system 250 are double seals 172, while the seals on the low pressure side of the fluid distribution system 250 are single seals 170. The high pressure side of the fluid distribution system 250 includes all seals in contact with the second bellows block 108B, output manifold 212, flow sensor 128, connector 208B, and the fourth bellows block 108D. The low pressure side of the fluid distribution system 250 includes all seals in contact with the first bellows block 108A, input manifold 204, connector 208A, and the third bellows block 108C.

It should be understood that different elements are shown in different drawings herein to aid clarity. However, for similar constructions and structures, the same elements should be understood to be present. For example, although FIG. 2B does not show the fourth bellow block outlet port 168, it should be understood as present since it has the same structure as FIG. 2A.

Referring now to FIG. 3A, a diagram illustrating an isometric view of a fluid transfer system 300 in accordance with a first embodiment of the present invention is shown. Fluid transfer system 300 refers to a structure that includes a fluid distribution system 100 or 150 shown and described with reference to FIGS. 1A and 1B. Fluid transfer system 300 is a modular assembly able to be installed or removed from a cabinet or other protective enclosure. In order to facilitate modular installation or removal, all assemblies of fluid transfer system 300 are mounted to a mounting platform 304. The mounting platform 304 is typically a sheet of aluminum or steel that may include handles or similar means to facilitate installation, carrying, and removal.

The fluid transfer system 300 may also include one or more pump assemblies 312. Each of the pump assemblies 312 includes one or more pumps 308 and pump motors 316. The pumps 308 and pump motors 316 may be of any configuration, and include but are not limited to hydraulic or pneumatic pumps. The pump assembly 312 interfaces to each of the pumping bellows 104A, 104B through pump isolation valves 320A, 320B, respectively. Pump isolation valves 320A, 320B are two-way valves that independently isolate each of the pumping bellows 104A, 104B from the pump 308. In some embodiments, pump assemblies 312 are part of fluid transfer system 300, and in other embodiments, pump assemblies 312 are external to fluid transfer system 300. Combining pump assemblies 312 with the fluid transfer system 300 advantageously minimizes the number of attachment points and facilitates rapid installation or removal of fluid transfer system 300.

Each of the bars and blocks of the fluid distribution system 100, 150 may be constructed from various materials, including but not limited to aluminum (for example, type 6061-T6 in the preferred embodiment), steel, stainless steel (for example, types 303, 304, or 316), or plastics. It is important that materials be selected in order to not chemically react or corrode with the specific fluid 132, 136 used. Also, materials must be selected in order to reliably handle the expected pressures, especially in the upper fluid distribution assembly 364 where higher pressures are encountered.

Referring now to FIG. 3B, a diagram illustrating an isometric view of a fluid transfer system with a separated pump assembly in accordance with a first embodiment of the present invention is shown. FIG. 3B illustrates a fluid transfer system 330, which includes fluid distribution system 100 or 150 attached to the mounting platform 304. The pump assembly 312 is shown separated from the fluid distribution system 100, 150 in order to more clearly illustrate the various components, which includes the four bellows blocks 108A-108D, the pumping bellows 104A, 104B, the lower inlet bar 116, exit block 112, upper inlet bar 120, sensor bar 124, flow sensor 128, and all seals 170, 172 between them. In one embodiment, only the lower bellows blocks (first bellows block 108A and third bellows block 108C) are rigidly attached to the mounting platform 304. The other blocks and bars are fastened between the four bellow blocks 108A-108D. Therefore, once the first 108A and third 108C bellows blocks have been unfastened from the mounting platform 304, the fluid distribution system 100, 150 may be further disassembled or replaced.

Referring now to FIG. 3C, a diagram illustrating an isometric view of a fluid distribution system 360 with separated upper and lower distribution assemblies in accordance with a first embodiment of the present invention is shown. After the pump assembly 312 has been removed from the fluid transfer system 300, either the entire fluid distribution system 100, 150 may be removed from the mounting platform 304 as previously described, or the fluid distribution system 100, 150 may be separated for servicing one or more of the pumping bellows 104A, 104B. Fluid distribution system 100, 150 includes an upper fluid distribution assembly 364 and a lower fluid distribution assembly 368. The upper fluid distribution assembly 364 includes the second bellows block 108B, the fourth bellows block 108D, the upper inlet bar 120, the sensor bar 124, the flow sensor 128, and all seals 170, 172 between them. The lower fluid distribution assembly 368 includes the first bellows block 108A, the third bellows block 108C, the pumping bellows 104A, 104B, the lower inlet bar 116, the exit block 112, and all seals 170, 172 between them. By removing fasteners between the first 108A and second 108B bellows blocks and between the third 108C and fourth 108D bellows blocks, the upper fluid distribution assembly 364 may be separated from the lower fluid distribution assembly 368. The second 142 and fourth 146 couplings (including seals 170 or 172) are then readily accessible, with the first 140 and third 144 couplings accessible following removal of the first 104A and third 104B pumping bellows. By providing assembly modularity, serviceability of all parts of the fluid distribution system 100, 150 is enhanced.

Because the first 108A and third 108C bellows blocks are closest to the mounting platform 304 and the fluid transfer system 300, 330, 360 is illustrated as shown, the first 108A and third 108C bellows blocks may also be referred to as "lower bellows blocks". Similarly, because the second 108B and fourth 108D bellows blocks are furthest from the mounting platform 304 and the fluid transfer system 300, 330, 360 is illustrated as shown, the second 108B and fourth 108D bellows blocks may also be referred to as "upper bellows blocks".

Referring now to FIG. 4A, a diagram illustrating an isometric view of a fluid transfer system 400 in accordance with a second embodiment of the present invention is shown. Fluid transfer system 400 refers to a structure that includes a fluid distribution system 200 or 250 shown and described with reference to FIGS. 2A and 2B. Fluid transfer system 400 is a modular assembly able to be installed or removed from a cabinet or other protective enclosure. In order to facilitate modular installation or removal, all assemblies of fluid transfer system 400 are mounted to a mounting platform 304. The mounting platform 304 is typically a sheet of aluminum or steel that may include handles or similar means to facilitate installation, carrying, and removal.

The fluid transfer system 400 may also include one or more pump assemblies 412. Each of the pump assemblies 412 includes one or more pumps 408 and pump motors 416. The pumps 408 and pump motors 416 may be of any configuration, and include but are not limited to hydraulic or pneumatic pumps. The pump assembly 412 interfaces to each of the pumping bellows 104A, 104B through pump isolation valves 420A, 420B, respectively. Pump isolation valves 420A, 420B are two-way valves that independently isolate each of the pumping bellows 104A, 104B from the pump 408. In some embodiments, pump assemblies 412 are part of fluid transfer system 400, and in other embodiments, pump assemblies 412 are external to fluid transfer system 400. Combining pump assemblies 412 with the fluid transfer system 400 advantageously minimizes the number of attachment points and facilitates rapid installation or removal of fluid transfer system 400.

Each of the bars and blocks of the fluid distribution system 200, 250 may be constructed from various materials, including but not limited to aluminum (for example, type 6061-T6 in the preferred embodiment), steel, stainless steel (for example, types 303, 304, or 316), or plastics. It is important that materials be selected in order to not chemically react or corrode with the specific fluid 132, 136 used. Also, materials must be selected in order to reliably handle the expected pressures, especially in the upper fluid distribution assembly 464 where higher pressures are encountered.

Referring now to FIG. 4B, a diagram illustrating an isometric view of a fluid transfer system 430 with a separated pump assembly in accordance with a second embodiment of the present invention is shown. FIG. 4B illustrates a fluid transfer system 430, which includes fluid distribution system 200 or 250 attached to the mounting platform 304. The pump assembly 412 is shown separated from the fluid distribution system 200, 250 in order to more clearly illustrate the various components, which includes the four bellows blocks 108A-108D, the pumping bellows 104A, 104B, the input manifold 204, the output manifold 212, connectors 208A, 208B, flow sensor 128, and all seals 170, 172 between them. In one embodiment, only the lower bellows blocks (first bellows block 108A and third bellows block 108C) are rigidly attached to the mounting platform 304. The other blocks and bars are fastened between the four bellow blocks 108A-108D. Therefore, once the first 108A and third 108C bellows blocks have been unfastened from the mounting platform 304, the fluid distribution system 200, 250 may be further disassembled or replaced.

Referring now to FIG. 4C, a diagram illustrating an isometric view of a fluid transfer system 460 with separated upper and lower distribution assemblies in accordance with a second embodiment of the present invention is shown. After the pump assembly 412 has been removed from the fluid transfer system 400, either the entire fluid distribution system 200, 250 may be removed from the mounting platform 304 as previously described, or the fluid distribution system 200, 250 may be separated for servicing one or more of the pumping bellows 104A, 104B. Fluid distribution system 200, 250 includes an upper fluid distribution assembly 464 and a lower fluid distribution assembly 468. The upper fluid distribution assembly 464 includes the second bellows block 108B, the fourth bellows block 108D, the output manifold 212, the connector 208B, the flow sensor 128, and all seals 170, 172 between them. The lower fluid distribution assembly 468 includes the first bellows block 108A, the third bellows block 108C, the input manifold 204, the connector 208A, and all seals 170, 172 between them. By removing fasteners between the first 108A and second 108B bellows blocks and between the third 108C and fourth 108D bellows blocks, the upper fluid distribution assembly 464 may be separated from the lower fluid distribution assembly 468. The second 142 and fourth 146 couplings (including seals 170 or 172) are then readily accessible, with the first 140 and third 144 couplings accessible following removal of the first 104A and third 104B pumping bellows. By providing assembly modularity, serviceability of all parts of the fluid distribution system 200, 250 is enhanced.

Because the first 108A and third 108C bellows blocks are closest to the mounting platform 304 and the fluid transfer system 400, 430, 460 is illustrated as shown, the first 108A and third 108C bellows blocks may also be referred to as "lower bellows blocks". Similarly, because the second 108B and fourth 108D bellows blocks are furthest from the mounting platform 304 and the fluid transfer system 400, 430, 460 is illustrated as shown, the second 108B and fourth 108D bellows blocks may also be referred to as "upper bellows blocks".

Referring now to FIG. 5A, a diagram illustrating a single seal connection in accordance with embodiments of the present invention is shown. FIG. 5A illustrates a portion of fluid distribution system 200 including the fourth bellows block 108D, a single seal 170, and connector 208B. Mating faces include recesses to accept the single seal 170, and the dimensions and positioning of the recesses depends on the dimensions and materials of the single seals 170. The single seals 170 may be any suitable material to prevent fluid leakage at the pressures the connection was intended for. For example, the seals 170 may be rubber, Teflon, or metal seals (copper, stainless steel, or composite). In the preferred embodiment, the seals 170 are Viton.

Referring now to FIG. 5B, a diagram illustrating dual seal connections in accordance with embodiments of the present invention is shown. FIG. 5B illustrates a portion of fluid distribution system 250 including the fourth bellows block 108D, a double or dual seals 172, and connector 208B. Mating faces include recesses to accept the dual seals 172, and the dimensions and positioning of the recesses depends on the dimensions and materials of the dual seals 172. The dual seals 172 may be any suitable material to prevent fluid leakage at the pressures the connection was intended for. For example, the seals 172 may be rubber, Teflon, or metal seals (copper, stainless steel, or composite). In the preferred embodiment, the seals 172 are Viton. In one embodiment, each of the individual seals in a dual seal 172 may be the same material. In another embodiment, each of the individual seals in a dual seal 172 may be a different material.

The various views and illustration of components provided in the figures are representative of exemplary systems, environments, and methodologies for performing novel aspects of the disclosure. For example, those skilled in the art will understand and appreciate that a component could alternatively be represented as a group of interrelated subcomponents attached through various temporarily or permanently configured means. Moreover, not all components illustrated herein may be required for a novel embodiment, in some components illustrated may be present while others are not.

The descriptions and figures included herein depict specific embodiments to teach those skilled in the art how to make and use the best option. For the purpose of teaching inventive principles, some conventional aspects have been simplified or omitted. Those skilled in the art will appreciate variations from these embodiments that fall within the scope of the invention. Those skilled in the art will also appreciate that the features described above can be combined in various ways to form multiple embodiments. As a result, the invention is not limited to the specific embodiments described above, but only by the claims and their equivalents.

Finally, those skilled in the art should appreciate that they can readily use the disclosed conception and specific embodiments as a basis for designing or modifying other structures for carrying out the same purposes of the present invention without departing from the spirit and scope of the invention as defined by the appended claims.

I claim:

1. A system, comprising:

a plurality of bellow assemblies, each comprising:

a first bellows block;

a second bellows block; and a pumping bellow comprising a first bellow port and a second bellow port, the pumping bellow disposed between the first and second bellows blocks and coupled to one or more pumps configured to cause the pumping bellow to pressurize a fluid to a pressurized state;

an input manifold, disposed between the first bellows blocks of the plurality of bellow assemblies and configured to route the fluid between the first bellows blocks, one first bellows block of the plurality of bellow assemblies comprising a master fluid inlet port configured to receive the fluid from a storage tank and route the fluid to the input manifold;

an output manifold, disposed between the second bellows blocks of the plurality of bellow assemblies and configured to route the fluid between the second bellows blocks, one second bellows block of the plurality of bellow assemblies comprising a master fluid outlet port and configured to route the fluid in the pressurized state from the second bellows blocks to the master fluid outlet port, the master fluid outlet port configured to deliver the fluid in the pressurized state to a gas distribution network; and a plurality of seals disposed along fluid transfer pathways at seal locations comprising between the first and second bellows blocks and the pumping bellow, between each of the first bellows blocks and the input manifold, and between each of the second bellows blocks and the output manifold.

2. The system of claim 1, wherein the plurality of seals comprises one or more chemically-resistant seals at each seal location.

3. The system of claim 1, wherein the plurality of seals comprises two redundant chemically-resistant seals at each seal location.

4. The system of claim 1, further comprising:

a mounting platform, wherein fasteners couple the plurality of bellow assemblies to the mounting platform, wherein the system when mounted in a cabinet may be removed by removing the fasteners, connections to the master fluid inlet and outlet ports, and a connection to the flow sensor in response to a flow sensor being present.

5. A system, comprising:

a mounting platform;

a plurality of bellow assemblies, coupled to the mounting platform, each comprising:

a lower bellows block, configured to receive a fluid at a lower pressure;

a pumping bellow, configured to receive the fluid at a lower pressure from the lowers bellows block and pressurize the fluid to a higher pressure; and an upper bellows block, configured to receive the fluid at a higher pressure from the pumping bellow, one upper bellows block configured to supply the fluid at the higher pressure to a gas distribution network;

an input manifold, coupled to each of the lower bellows blocks, configured to receive the fluid at a lower pressure and distribute the fluid to each of the lower bellows blocks;

an output manifold, coupled to each of the upper bellows blocks, configured to receive the fluid at a higher pressure and distribute the fluid to each of the upper bellows blocks; and a plurality of chemically-resistant replaceable seals, disposed between the pumping bellows and the bellows blocks, between the input manifold and each of the lower bellows blocks, and between the output manifold and each of the upper bellows blocks.

* * * * *